United States Patent [19]

Finke et al.

[11] 4,194,683

[45] Mar. 25, 1980

[54] COIN VAULT

[75] Inventors: Theodore R. Finke, Euclid; Edward M. Mavko, Madison, both of Ohio

[73] Assignee: The Euclid Products Co., Inc., Willoughby, Ohio

[21] Appl. No.: 973,577

[22] Filed: Dec. 27, 1978

Related U.S. Application Data

[63] Continuation of Ser. No. 885,352, Mar. 13, 1978.

[51] Int. Cl.[2] ..... G07B 15/00

[52] U.S. Cl. ..... 232/15

[58] Field of Search ..... 232/15, 16

[56] References Cited

U.S. PATENT DOCUMENTS

| | | | |
|---|---|---|---|
| 218,781 | 8/1879 | Schegell | 232/15 |
| 1,280,351 | 10/1918 | Woods | 232/15 |
| 2,146,974 | 2/1939 | Mitford et al. | 232/15 |
| 3,083,896 | 4/1963 | Cairelli et al. | 232/15 |
| 3,677,461 | 7/1972 | Nitschneider et al. | 232/15 |
| 3,926,366 | 12/1975 | Sciortino | 232/15 |

*Primary Examiner*—William H. Schultz
*Assistant Examiner*—Peter A. Aschenbrenner
*Attorney, Agent, or Firm*—Bosworth, Sessions & McCoy

[57] ABSTRACT

A coin vault for securing coins, tokens, etc, deposited in a receiving device, such as a fare box. The vault is removable positioned in the fare box and preferably locked therein with a key lock. A spring-loaded inwardly opening door on the top of the vault is unlatched to open when the vault is positioned in the fare box and automatically latched when the vault is removed. A locking lever carrying a latch cooperable with a catch on the door is mounted within the vault and is pivotable between a latching position to lock the door closed, a primary unlatching position, and an intermediate unlatching position. The lever is urged by a spring to its latching position and is held in its primary unlatching position by one detent and in its intermediate unlatching position by a second detent. Before placement in the fare box, the lever is moved from its latching position to its primary unlatching position by a key-operated cylinder lock; when the vault is positioned in the fare box, the second detent automatically releases the first detent while at the same time detaining the lever in its intermediate unlatching position. When the vault is removed from the fare box, the second detent is released so that the lever automatically moves to its latching position. The vault is then carried to a collection point where the vault door may be unlatched with a key.

14 Claims, 10 Drawing Figures

FIG. 3
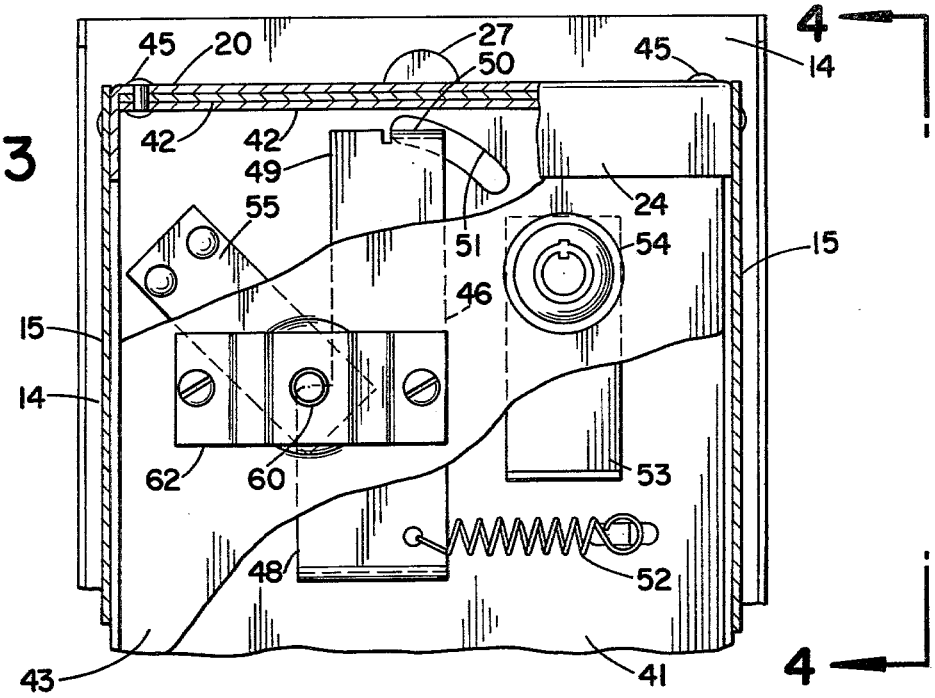
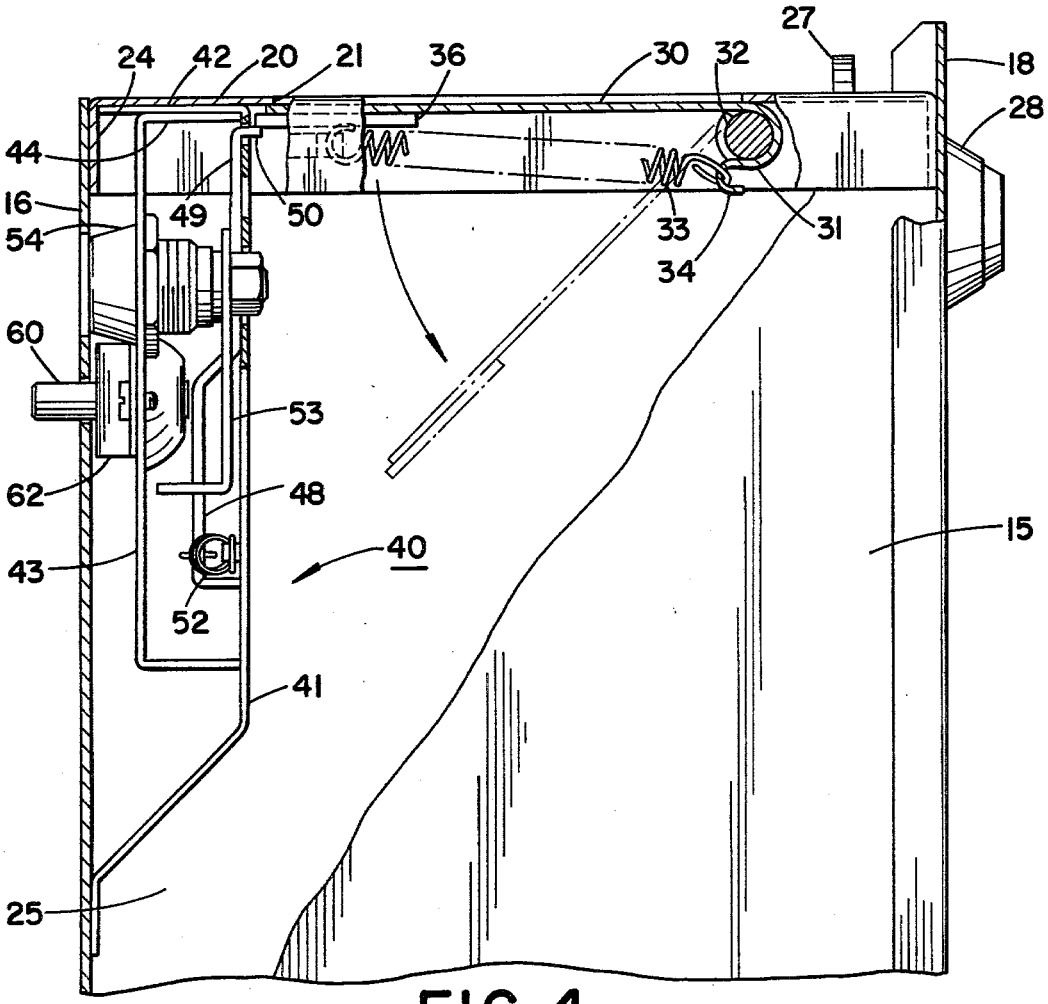
FIG. 4

COIN VAULT

This is a continuation, of application Ser. No. 885,352, filed Mar. 13, 1978.

BACKGROUND OF THE INVENTION

This invention relates to coin-receiving devices, such as, but not limited to, fare boxes, and the like, for the collection of fares, such as coins, tickets, tokens, etc., and especially, although not necessarily, to such fare boxes as used in transportation facilities, such as buses, streetcars, commuter trains, and the like. More particularly, the invention relates to a tamperproof coin vault adapted to receive coins deposited in the fare box, or the like, and retain them in a secure position, both while the vault is in position in the fare box, or the like, and after it is removed until it is taken to a predetermined collection point for emptying and checking the received contents.

Coin vaults of the type described must have special security features, particularly in view of the ever increasing possibility of robbery and theft from public transportation vehicles. Accordingly, it is not only necessary that the coin vault be locked in the fare box, or the like, to prevent unauthorized removal or pilfering during operation of the vehicle, or the like, but also that provision be made to secure the contents of the vault between the time that the vault is being taken from the vehicle to a suitable secure collection point.

Typical prior art coin vaults designed for this purpose are shown in U.S. Pat. Nos. 118,927; 218,781; 2,119,592; 2,146,974; and 2,371,114.

A fare box with which a coin vault embodying the present invention is advantageously used is preferably of the type mounted upon a stand or upon the floor of a vehicle and adapted to remain in the vehicle. The fare box contains the removable coin box or vault which is locked in place and can only be removed by a person or persons authorized to do so. The top or closure of the removable coin vault or box is preferably provided with a tiltable lid which serves as an inspection plate permitting the conductor or driver to inspect the coins or other medium of fare prior to their discharge into the coin receptacle or vault. When the removable coin receptacle is in place within the fare box cabinet, its lid or inspection plate is supported beneath and adjacent an opening in the bottom of the hopper of the fare box, which hopper is provided with a glass wall or walls so that the inspection plate is visible.

The vault is normally adapted to be contained in the bottom portion of the fare box and to receive the fares and coins deposited therein. Such vault has a door for closing an opening, together with means for automatically closing and locking the door when the vault is removed from the fare box.

Prior art coin vaults, however, are generally too cumbersome for smaller vehicles, such as minibuses, and the like, in common use today.

The coin vault of the presnt invention, however, resolves the difficulty indicated above and affords other features and advantages heretofore not obtainable.

SUMMARY OF THE INVENTION

It is among the objects of the invention to provide improved security for coin vaults of the type described to better protect the contents thereof against tampering, theft, pilferage, or opening by unauthorized persons.

Still another object of the invention is to provide automatic means to lock the door of a coin vault whenever a vault is removed from its operating position, such as in a fare box, so that the vault cannot thereafter be opened, except by a person having a key.

These and other objects and advantages are achieved with the novel coin vault construction of the invention, wherein the vault, which is adapted to be removably positioned in the fare box and locked therein, for example, with a key lock, comprises a vault chamber defined by strong sheet metal elements fastened together in such a way as to avoid disassembly, and having an opening at the top for receiving coins, tickets, tokens, or the like, that have been deposited in the fare box. A hinged door is mounted within the vault chamber so as to close the opening, and is movable between a closed position and an inwardly extending open position to permit transfer of coins from the fare box to the vault chamber.

Normally, the door is operable by a lever on the fare box with an arm that is adapted to press the door downward. The door has resilient means urging it to its closed position.

Also, mounted within the vault is a locking lever with an operating arm and a latch-carrying arm with a latch that cooperates with a catch on the door to lock the door in a closed position. The locking lever is pivotable about a central axis between a latching position to lock the door in its closed position, a primary unlatching position, and an intermediate latching position. Resilient means are provided to urge the lever to its latching position.

The lever can be retained in its primary unlatching position by a first detent means movable between a position for holding the lever and a retracted position. The first detent means is urged into its holding position by a resilient means.

The lever is also adapted to be held in its intermediate latching position by a second detent means that also serves to simultaneously move the first detent means to its retracted position to release the lever from its primary unlatching position. The second detent means includes a plunger that is movable between a depressed detaining position for holding the lever in its unlatching position and an extended position to which it is urged by a spring.

The plunger is automatically depressed when the vault is placed in the fare box merely through engagement of the plunger with an adjacent wall of the fare box. This engagement moves the plunger to its depressed position to release the first detent means and also to hold the lever in the intermediate unlatching position until the vault is removed. When the vault is removed, the plunger is released to its retracted position which, in turn, causes the lever to be released and move automatically to its latched position. The door may be unlocked by a key-actuated arm that engages the lever and moves it back to its primary unlatching position.

BRIEF DESCRIPTION OF THE DRAWINGS

FIG. 3 is a fragmentary, sectional view taken on the line 3—3 of FIG. 2 with parts broken away for the purpose of illustration;

FIG. 4 is a fragmentary, sectional view taken on the line 4—4 of FIG. 3 with parts broken away for the purpose of illustration;

DESCRIPTION OF THE PREFERRED EMBODIMENT

Figure 1:
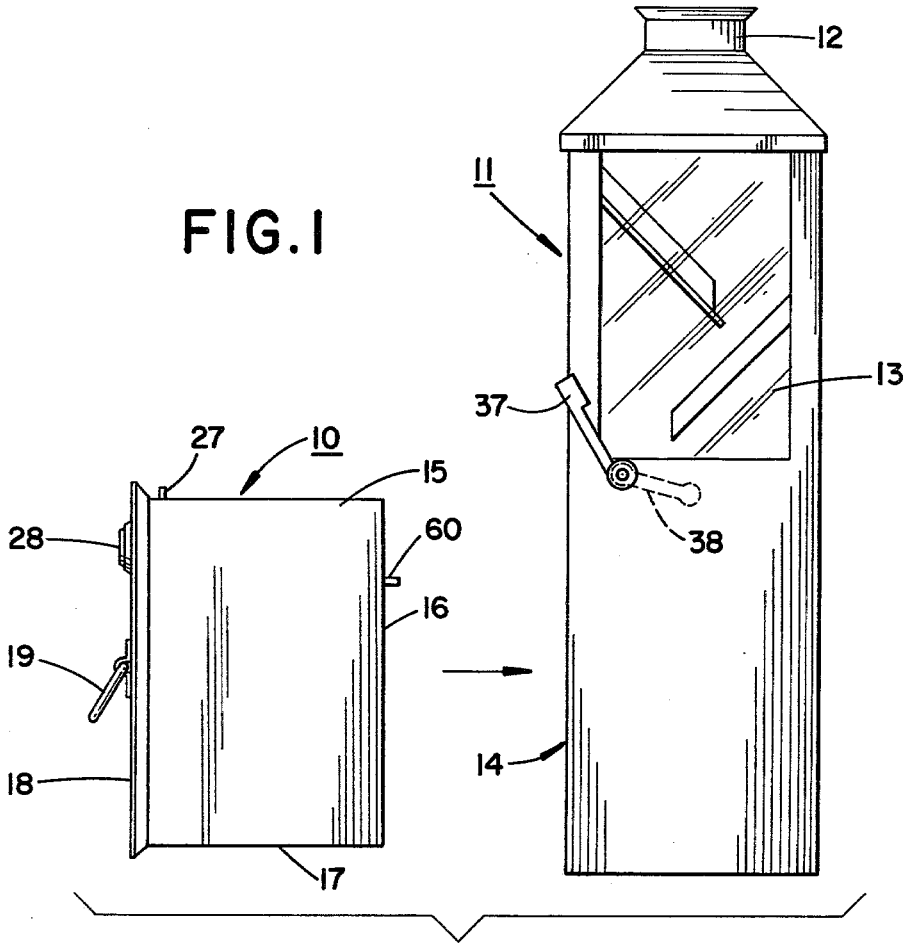
FIG. 1 is an elevational view showing a coin vault and a fare box adapted to receive the coin vault which, in turn, receives coins deposited in the fare box.
Figure 2:
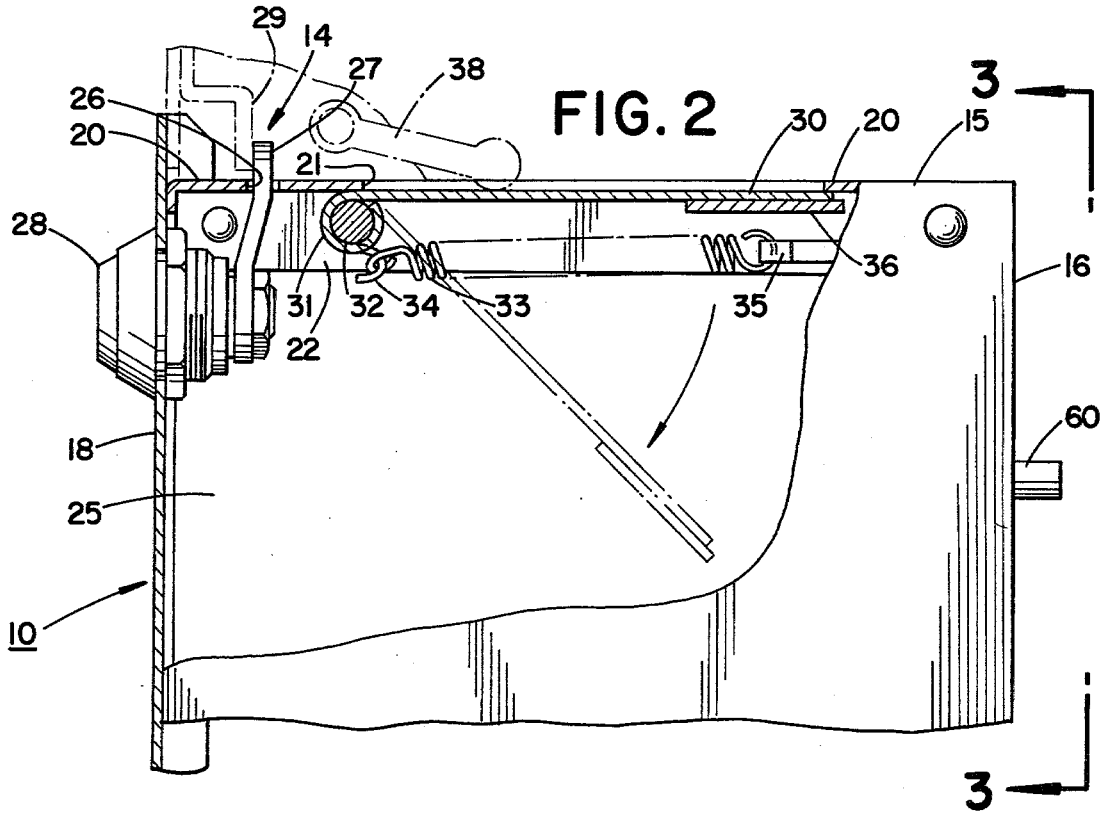
FIG. 2 is a fragmentary, elevational view on an enlarged scale of the coin vault of FIG. 1 with parts broken away and shown in section for the purpose of illustration.

Referring more particularly to the Drawings and initially to FIGS. 1 and 2, there is shown a coin vault 10 embodying the invention and adapted for use in a conventional fare box 11, such as the type used on buses, streetcars, rapid transits, and more recently on the popular "minibuses" that are now becoming widely used in shuttle-type applications. The fare box 11 has an opening 12 for coins at the top and a receiving chamber below which usually has at least one transparent wall so that an operator may view the amount of fare deposited. Below the receiving chamber 13, is a space 14 for the coin vault 10 which is slid into position in the space 14 in the direction indicated by the arrow in FIG. 1.

The coin vault 10 is formed of high strength sheet steel sections fastened together by welding and by rivets in such a way as to prevent any disassembly except by extraordinary means, such as by a cutting torch. The sheet metal members include a U-shaped section including side walls 15 and a rear wall 16, a floor plate 17, a front plate 18 with a handle 19 and a top plate 20 with a rectangular opening 21 through which coins may pass from the receiving chamber 13. The top plate 20 has perpendicular side flanges 22, a front flange 23 and a rear flange 24.

The various sheet steel sections in assembled relation define a vault chamber 25 in which coins, tickets, tokens, or the like, may be securely stored while the fare box 11 is in use and also during transport of the coins in the coin vault 10 from the fare box to a convenient collection station.

The top plate 20 also has a slot 26 to permit movement of a latch 27 operated by a key lock 28 and cooperable with a catch 29 in the fare box 11. The latch 27 serves to lock the coin vault 10 in the fare box 11 once it is in operating position and thus prevents unauthorized removal.

A rectangular door 30 is positioned immediately below the rectangular opening 21 and is pivotable between a closed position, shown in solid lines in FIGS. 2, 4, 5, 7 and 9, and an open position, shown in dashed lines in FIGS. 2, 4, 5 and 9. The door 30 has a hinge 31 at one end that receives a hinge pin 32 pivotally supported at its opposite ends in circular openings in the side flanges 22 of the top plate 20. The door 30 is biased to its closed position by a helical spring 33 connected at one end to a hook 34 on the hinge 31 and at the other end to a hook 35 secured to one of the side flanges 22. The door also has a catch plate 36 at its outer end used to lock the door in a closed position, as will be described in more detail below.

The door 30 is operated when properly installed in the fare box by means of a door lever 37 on the fare box 11 that has a door-engaging arm 38 positioned to engage and press the door 30 downward to its open position when a vehicle operator desires to transfer coins from the receiving chamber 13 to the vault chamber 25.

In accordance with the invention, the coin vault 10 is provided with a door latch mechanism 40 with a unique function that automatically secures the vault by latching the door whenever the vault is removed from the fare box 11. The latch mechanism 40 comprises a main mounting plate 41 with a top flange 42 and a rear mounting plate 43 with a top flange 44. The flanges 42 and 44 are placed adjacent one another and attached to the top plate 20 with rivets 45 as best illustrated in FIG. 3. The mounting plates 41 and 43 support the various operating elements of the latch mechanism.

The latch mechanism 40 includes a lever 46 supported on the main mounting plate 41 by a pivot pin 47. The lever 46 includes a downwardly extending operating arm 48 and an upwardly extending latch carrier arm 49, as best seen in FIGS. 3 and 4. The latch carrier arm 49 has a latch 50 at its outer end that extends through a curved slot 51 in the main mounting plate 41 and is adapted for operating engagement with the catch plate 36 on the door 30, as will be described below.

The lever 40 is pivotable between a door-latching position illustrated in FIGS. 3, 4, 7 and 8, wherein the lever is essentially vertical and the latch 50 is positioned against the catch plate 36 to lock the door 30 in a closed position. The lever 46 is pivotable to a primary unlatching position, illustrated in FIGS. 9 and 10, and an intermediate unlatching position, illustrated in FIGS. 5 and 6. In both of these unlatching positions, the catch 50 is moved to the opposite end of the curved slot 51 so that it does not engage the catch plate 36 and thus permits the door 30 to be opened freely, either with the door lever 37 on the fare box, or, if the vault 10 is removed from the fare box, by a person desiring to empty the contents of the vault.

The lever 46 is biased to its latching position by means of a helical spring 52 connected to the outer end of the operating arm 48 at one end, and at the opposite end to a spring hook on the main mounting plate 41.

Figure 9:
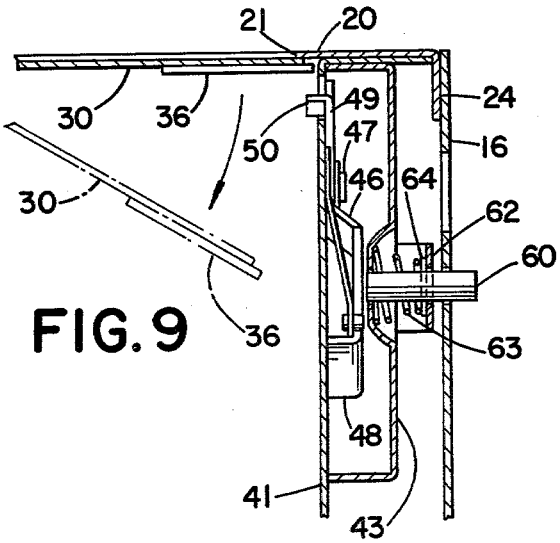
Figure 10:
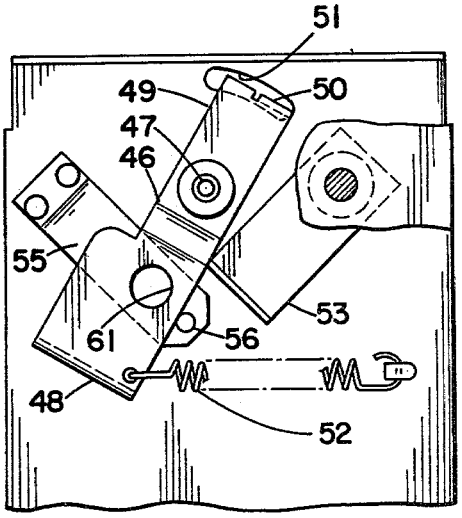

The lever 46 may be manually moved from its latching position to its primary unlatching position using a key lock 53 with an unlatching arm 54 operated thereby and which is pivoted into engagement with the operating arm, as illustrated in FIGS. 9 and 10, to move the operating arm over to its primary unlatching position.

In order to hold the lever 46 automatically in its unlatching position whenever it is moved to that position by the key lock 53 and unlatching arm 54, there is provided a detent element 55 including a leaf spring 56 riveted to the main mounting plate 41 and which has a detent pin 57 on its outer end which is urged into a detaining position against an edge of the operating arm 48 to prevent the lever 46 from moving out of its primary unlatching position, as illustrated in FIGS. 9 and 10.

In order to release the detent element 55 from the position illustrated in FIGS. 9 and 10, there is provided a plunger 60 that may be pushed through a circular opening 61 within the operating arm 48 with which the plunger 60 registers when the operating arm 48 is in its primary unlatching position. The plunger 60 is mounted by means of a bracket 62 mounted on the rear mounting plate 43 and the plunger 60 is movable through an opening in the bracket 62 between an outwardly extending retracted position illustrated in FIGS. 1, 2, 4, 7 and 9, and an inwardly extending detent position, illustrated in FIG. 5. The plunger 60 is biased to its outwardly extending position by means of a helical spring 63 which bears between the rear mounting plate 43 and a locking ring 64, secured in an annular slot on the plunger 60. The locking ring also bears against the bracket 62 and limits the outward extension of the plunger.

Figure 5:
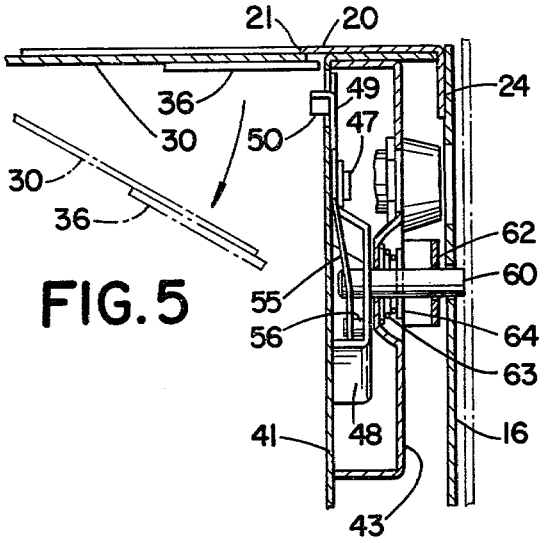
FIGS. 5, 7 and 9 are fragmentary, sectional views similar to FIG. 4, but in reverse position, and illustrating sequentially the operation of the door-latching mechanism of the invention.
Figure 6:
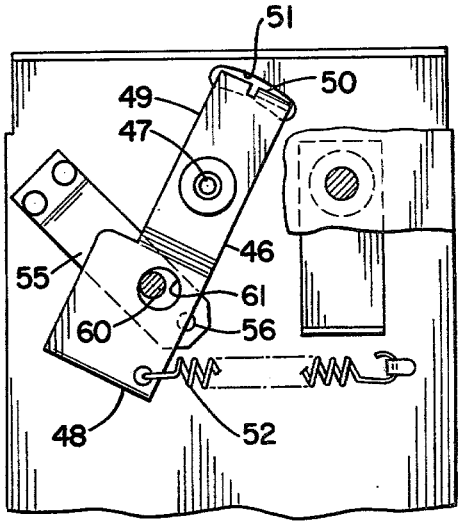
FIGS. 6, 8 and 10 are fragmentary, sectional views similar to FIG. 3, but on a reduced scale, illustrating sequentially the operation of the mechanism and in conditions corresponding to those of FIGS. 5, 7 and 9, respectively.
Figure 7:
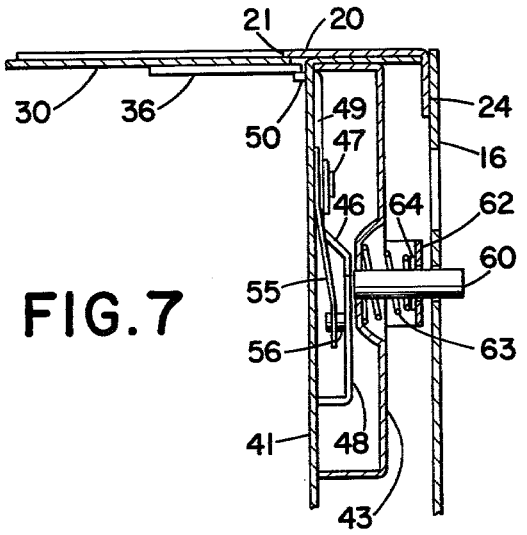
Figure 8:
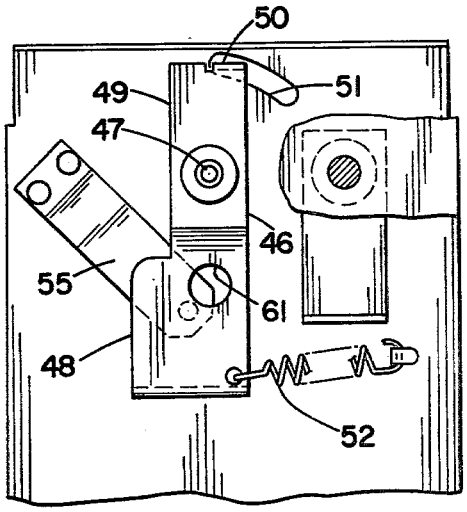

When the plunger 60 is pressed against the force of the spring 63 to its inwardly extending depressed condition illustrated in FIG. 5, the inner end of the plunger passes through the opening 61 in the operating arm 48, engages the leaf spring 56 and flexes the leaf spring in such a way as to bring the detent pin 56 away from engagement with the edge of the operating arm 48. This releases the lever 46 from its primary unlatching position and it is pulled by the force of the spring 52 to its intermediate unlatching position where further movement is prevented by engagement between the inwardly extending depressed plunger 60 and the edge of the hole 61 in the operating arm 48.

It will be noted that when the coin vault 10 is initially inserted in the fare box, the key lock 54 will have been operated to move the lever 46 to its unlatching position. Then, when the coin vault 10 is slid into the fare box 11, the back wall of the vault space in the fare box engages the plunger 60 and the plunger is automatically depressed to the position shown in FIG. 5. This forces the plunger through the hole 61 in the operating arm 48, flexes the spring 56 to bring the detent pin out of its detaining position engaging the edge of the operating arm 48 and releases the lever 46 from its primary unlatching position so that it is pulled into its intermediate unlatching position, where it is held by engagement between the edge of the hole 61 and the plunger 60. In this way, the door 30 is unlocked so as to be operable by the door lever 37 on the fare box so that the operator may transfer coins from the receiving chamber 13 into the vault chamber 25.

When the coin vault 10 is to be removed from the fare box 11, the key lock 29 on the front plate 18 is unlocked by a key to move the latch 27 out of engagement with the catch 28. Then as the vault 10 is slid out, the plunger 60 is forced by the helical spring 63 to its retracted outwardly extending position to release the operating arm 48 and cause the lever 46 to be forced by the helical spring 52 to the locking position illustrated in FIGS. 7 and 8. The lever 60 cannot be moved out of its locking position except by use of a key to operate the key lock 54.

When the coin vault has been transported to a convenient collection station, an authorized person may use the key to operate the key lock 54 which moves the unlatching arm 53 against the operating arm 58 of the lever 56, as illustrated in FIGS. 9 and 10, to move the lever to its primary unlatching position where it is held by the leaf spring 56 and detent pin 57. This releases the door 30 so that the contents of the vault 10 may be emptied out.

While the invention has been shown and described with respect to a preferred embodiment thereof, this is intended for the purpose of illustration rather than limitation and other modifications and variations of the specific device herein shown and described will be apparent to those skilled in the art. Accordingly, the patent is not to be limited in scope and effect to the specific embodiment herein shown and described, nor in any other way that is inconsistent with the extent to which the progress in the art has been advanced by the invention.

We claim:

1. A vault for coins, tokens, and the like, adapted to be locked in a receiving apparatus and removed therefrom with coins, tokens, and the like, locked therein comprising means defining a vault chamber with an opening at the top thereof for receiving coins, and the like, from said receiving apparatus, a hinged door in said vault chamber movable between a closed position and an inwardly extending open position for permitting transfer of coins, and the like, from said receiving apparatus to said vault chamber, catch means on said door, a locking lever having an operating arm and a latch-carrying arm with a latch that extends into said vault chamber and is cooperable with said catch, said locking lever being movable between a latching position to lock said door in its closed position, a primary unlatching position and an intermediate unlatching position, resilient means urging said lever to said latching position, first detent means movable between a detaining position for holding said lever in its primary unlatching position and a retracted position, resilient means urging said first detent means to said detaining position, second detent means movable between a depressed detaining position for holding said lever in its intermediate unlatching position and for simultaneously moving said first detent means to its retracted position, and an extended position, resilient means urging said second detent means to its extended position, said second detent means being depressed when said vault is placed in said receiving apparatus to detain said lever in said intermediate unlatching position, and unlocking means for moving said lever from its latching position to its primary unlatched position when said coin vault is removed from said coin-receiving apparatus.

2. A vault as defined in claim 1 wherein said receiving apparatus comprises a fare box.

3. A vault as defined in claim 1 wherein said resilient means urging said first detent means to said holding position comprises a member fixedly mounted at one end and flexible to accommodate movement of the opposite end and wherein said first detent means comprises a detent pin mounted on said opposite end and adapted to engage said operating arm in its holding position to hold said lever in its primary unlatching position.

4. A vault as defined in claim 3 wherein said member comprises a leaf spring.

5. A vault as defined in claim 1 including resilient means for urging said door to its closed position.

6. A vault as defined in claim 5 wherein said resilient means comprises a helical spring.

7. A vault as defined in claim 1 including means integral with said vault for locking said vault in position when placed in said receiving apparatus.

8. A vault as defined in claim 1 wherein said second detent means comprises a plunger that extends outwardly through said vault in its extended position and when depressed, extends inwardly to a position wherein it engages and flexes said resilient means for said first detent means to force said first detent means to its retracted position, and after said first detent means is retracted, engages said operating arm of said lever and holds said lever in its intermediate unlatching position.

9. A vault as defined in claim 1 wherein when said lever is held in its intermediate unlatching by said plunger, said operating arm of said lever blocks movement of said first detent means to its detaining so that when said plunger moves from its depressed position to its extended position, said lever is automatically moved to its latching position.

10. A vault as defined in claim 8 wherein said resilient means urging said plunger to its extended position comprises a helical spring.

11. A vault as defined in claim 1 wherein said unlocking means comprises a lock assembly integral with said vault and including an unlocking arm movable in response to operation of said lock assembly to engage said operating arm of said lever when said lever is in its latching position and move said operating arm to pivot said lever to its primary unlatching position where it is automatically detained by said first detent means.

12. A vault as defined in claim 11 wherein said lock assembly comprises a cylinder lock.

13. A vault for coins, tokens, and the like, adapted to be locked in a receiving apparatus and removed therefrom with coins, tokens, and the like, locked therein comprising means defining a vault chamber with an opening at the top thereof for receiving coins, and the like, from said receiving apparatus, a hinged door in said vault chamber movable between a closed position and an inwardly extending open position for permitting transfer of coins, and the like, from said receiving apparatus to said vault chamber, resilient means for urging said door to its closed position, catch means on said door, a locking lever having an operating arm and a latch-carrying arm with a latch that extends into said vault chamber and is cooperable with said catch, said locking lever being pivotable about a central axis between a latching position to lock said door in its closed position, a primary unlatching position and an intermediate unlatching position, resilient means urging said lever to said latching position, first detent means movable between a position for holding said lever in its primary unlatching position and a retracted position, resilient means urging said first detent means to said holding position, second detent means including a plunger movable between a depressed detaining position for holding said lever in its intermediate unlatching position and for simultaneously moving said first detent means to its retracted position, and an extended position, resilient means urging said plunger to its extended position, said plunger being depressed when said coin vault is placed in said coin-receiving apparatus to detain said lever in said intermediate unlatching position, and key-actuated means for moving said lever from its latching position to its primary unlatched position when said coin vault is removed from said coin-receiving apparatus.

14. A vault for coins, tokens, and the like, adapted to be locked in a receiving apparatus and removed therefrom with coins, tokens, and the like, locked therein comprising means defining a vault chamber with an opening at the top thereof for receiving coins, and the like, from said receiving apparatus, a hinged door in said vault chamber movable between a closed position and an inwardly extending open position for permitting transfer of coins, and the like, from said receiving apparatus to said vault chamber, catch means on said door, a locking lever having an operating arm and a latch-carrying arm with a latch that extends into said vault chamber and is cooperable with said catch, said locking lever being movable between a latching position to lock said door in its closed position, a primary unlatching position and an intermediate unlatching position, resilient means urging said lever to said latching position, first detent means movable between a detaining position for holding said lever in its primary unlatching position and a retracted position, resilient means urging said first detent means to said detaining position, second detent means adapted, when said vault is positioned in said receiving apparatus, to engage said lever and detain it in said intermediate unlatching position and to engage and move said first detent means to its retracted position, and unlocking means for moving said lever from its latching position to its primary unlatching position when said coin vault is removed from said coin-receiving apparatus.

* * * * *